US007592110B2

(12) United States Patent
Dinh et al.

(10) Patent No.: US 7,592,110 B2
(45) **Date of Patent: *Sep. 22, 2009**

(54) POLYHYDROXY SILOXANE PHOTOCONDUCTORS

(75) Inventors: Kenny-Tuan Dinh, Webster, NY (US); John F. Yanus, Webster, NY (US); Raymond K. Crandall, Rochester, NY (US); Edward J. Radigan, Jr., Scottsville, NY (US)

(73) Assignee: Xerox Corporation, Norwalk, CT (US)

( * ) Notice: Subject to any disclaimer, the term of this patent is extended or adjusted under 35 U.S.C. 154(b) by 479 days.

This patent is subject to a terminal disclaimer.

(21) Appl. No.: 11/705,932

(22) Filed: Feb. 13, 2007

(65) Prior Publication Data

US 2008/0193866 A1 Aug. 14, 2008

(51) Int. Cl.
*G03G 7/00* (2006.01)

(52) U.S. Cl. ..... 430/58.2; 430/66; 430/132

(58) Field of Classification Search ..... 430/58.2, 430/66, 132

See application file for complete search history.

(56) References Cited

U.S. PATENT DOCUMENTS

| | | | |
|---|---|---|---|
| 4,265,990 | A | 5/1981 | Stolka et al. |
| 4,464,450 | A | 8/1984 | Teuscher |
| 4,921,773 | A | 5/1990 | Melnyk et al. |
| 5,521,306 | A | 5/1996 | Burt et al. |
| 6,913,863 | B2 | 7/2005 | Wu et al. |
| 7,037,631 | B2 | 5/2006 | Wu et al. |
| 2004/0048177 | A1 | 3/2004 | Tamoto et al. |
| 2005/0266328 | A1 | 12/2005 | Yanagawa et al. |

OTHER PUBLICATIONS

John F. Yanus et al., U.S. Appl. No. 11/593,875 on Silanol Containing Overcoated Photoconductors, filed Nov. 7, 2006.

John F. Yanus et al., U.S. Appl. No. 11/593,657 on Overcoated Photoconductors with Thiophosphate Containing Charge Transport Layers, filed Nov. 7, 2006.

John F. Yanus et al., U.S. Appl. No. 11/593,656 on Silanol Containing Charge Transport Overcoated Photoconductors, filed Nov. 7, 2006.

John F. Yanus et al., U.S. Appl. No. 11/593,662 on Overcoated Photoconductors with Thiophosphate Containing Photogenerating Layer, filed Nov. 7, 2006.

*Primary Examiner*—Mark F Huff
*Assistant Examiner*—Rachel L Burney
(74) *Attorney, Agent, or Firm*—E. O. Palazzo

(57) ABSTRACT

An imaging member including an optional supporting substrate, a photogenerating layer, and at least one charge transport layer comprised of at least one charge transport component, and an overcoating layer in contact with and contiguous to the charge transport, and which overcoating is comprised of an acrylated polyol, a polyalkylene glycol, a crosslinking agent, a hydroxy functionalized siloxane and a charge transport component.

34 Claims, No Drawings

POLYHYDROXY SILOXANE PHOTOCONDUCTORS

CROSS REFERENCE TO RELATED APPLICATIONS

The disclosures of each of the following copending applications are totally incorporated herein by reference.

U.S. application Ser. No. 11/593,875, filed Nov. 7, 2006 on Silanol Containing Overcoated Photoconductors by John F. Yanus et al.

U.S. application Ser. No. 11/593,657, filed Nov. 7, 2006 on Overcoated Photoconductors with Thiophosphate Containing Charge Transport Layers by John F. Yanus et al.

U.S. application Ser. No. 11/593,656, filed Nov. 7, 2006 on Silanol Containing Charge Transport Overcoated Photoconductors by John F. Yanus et al.

U.S. application Ser. No. 11/593,662, filed Nov. 7, 2006 on Overcoated Photoconductors with Thiophosphate Containing Photogenerating Layer by John F. Yanus et al.

A number of the components and amounts thereof of the above copending applications, such as the supporting substrates, resin binders, photogenerating layer components, antioxidants, charge transport components, hole blocking layer components, overcoating (TOC) layer components, adhesive layers, and the like, may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a substrate, a photogenerating layer, and a charge transport layer, including a plurality of charge transport layers, such as a first charge transport layer and a second charge transport layer, an optional adhesive layer, an optional hole blocking or undercoat layer, and a top protective overcoating layer (TOC) containing a hydroxy functionalized siloxane modified polymer. In embodiments, the overcoating comprises, for example, a crosslinked resin, a charge transport component, a catalyst, and wherein the crosslinked resin is comprised of a polyol/polyester with hydroxyl/carboxy groups as the crosslinking sites, and a hydroxy functionalized siloxane modified polymer, such as SILCLEAN™ 3700R, available from BYK Chemi, which is believed to be a hydroxyl functionalized siloxane modified polyacrylate, and which hydroxy functionalized siloxane is present in various amounts, such as from about 0.1 to about 10 weight percent, from about 0.1 to about 2 weight percent, and which photoconductor possesses a desirable contact angle of, for example, about 103 compared to about 88 without the hydroxy functionalized siloxane modified polyacrylate. A number of advantages are associated with the photoconductors disclosed, such as crack resistance, hardness and toughness including scratch resistance; low surface energy characteristics, which characteristics can allow quantitative toner transfer and simplified photoconductor cleaning; substantial avoidance of cracks initiated in the layers below the TOC from propagating to the top layer and thus minimizing print defects; and where in embodiments the crosslinking sites will permit the reinforcement of the siloxane containing layer.

The photoreceptors illustrated herein, in embodiments, have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability. At least one in embodiments refers, for example, to one, to from 1 to about 10, to from 2 to about 7; to from 2 to about 4, to two, and the like.

Further disclosed are methods of imaging and printing with the photoresponsive or photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No.

3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically about 24 hours.

The appropriate components, and processes of the above recited patents may be selected for the present disclosure in embodiments thereof.

SUMMARY

Disclosed are imaging members with many of the advantages illustrated herein, such as extended lifetimes of service of, for example, in excess of about 3,000,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDCs (Photo-induced Discharge Curve); minimum cycle up in residual potential; acceptable background voltage that is, for example, a minimum background voltage of about 2.6 milliseconds after exposure of the photoconductor to a light source; rapid PIDCs together with low residual voltages, and the like.

Also disclosed are layered anti-scratch photoresponsive imaging members, which are responsive to near infrared radiation of from about 700 to about 900 nanometers, and are responsive to visible light.

Moreover, disclosed are layered belt photoresponsive or photoconductive imaging members with mechanically robust and solvent resistant charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

EMBODIMENTS

Aspects of the present disclosure relate to an imaging member comprising an optional supporting substrate, a photogenerating layer, at least one charge transport layer comprised of at least one charge transport component and an overcoating layer; a photoconductor comprising a supporting substrate, a photogenerating layer comprised of a photogenerating component, and at least one charge transport layer comprised of at least one charge transport component, and a crosslinked overcoating in contact with and contiguous to the charge transport, and which overcoating is comprised of a charge transport compound, a polymer, a hydroxy functionalized siloxane modified polymer, such as a block copolymer thereof, and which copolymer is dissolved in a suitable solvent like an alcohol prior to the reaction of the overcoating layer components, and a crosslinking component; a photoconductor comprised in sequence of a supporting substrate, a photogenerating layer comprised of at least one photogenerating pigment, thereover a charge transport layer comprised of at least one charge transport component; and a layer in contact with and contiguous to the top charge transport layer, and which layer is formed by the reaction of an acrylate polyol, an alkylene glycol, a crosslinking agent, a hydroxy functionalized siloxane modified polymer, and a charge transport compound in the presence of a catalyst resulting in a polymeric network primarily containing the acrylate polyol, the glycol, the crosslinking agent, the hydroxy functionalized siloxane modified polymer and the charge transport compound; a photoconductor wherein the acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$ represents $CH_2CR_1CO_2$— where t is from 0 to about 1, and represents the mole fraction acrylic groups on available sites, and where $R_a$ and $R_c$ independently represent at least one of an alkyl, an alkoxy, such as a linear alkyl group, a linear alkoxy group, a branched alkyl group, and a branched alkoxy group, wherein each alkyl and alkoxy group contains, for example, from about 1 to about 20 carbon atoms; $R_b$ and $R_d$ independently represent at least one of an alkyl and alkoxy wherein alkyl and alkoxy each contain, for example, from about 1 to about 20 carbon atoms; and m, n, p, and q represent mole fractions of from, for example, 0 to about 1, such that n+m+p+q=1, and wherein the polymeric network primarily contains the acrylate polyol, the glycol, the crosslinking agent, and the charge transport compound; a photoconductor containing a charge transport layer in contact with a top overcoating layer or POC, and which overcoating contains primarily an acrylated polyol, an alkylene glycol, wherein alkylene contains, for example, from 1 to about 10 carbon atoms, and more specifically, from 1 to about 4 carbon atoms, a charge transport, such as a hole transport compound, a polyhydroxy siloxane, and minor amounts of a catalyst and a crosslinking agent; a flexible imaging member comprising a supporting substrate, a photogenerating layer, and at least two charge transport layers, and in contact with the charge transport layer a top overcoating crosslinked layer comprised of a mixture of polyols, such as a mixture of an acrylated polyol and an alkylene glycol, a hydroxy functionalized siloxane modified polymer, a charge transport compound, a crosslinking agent, and which overcoating layer is formed in the presence of an acid catalyst; a photoconductive member comprised of a substrate, a photogenerating layer thereover, at least one to about three charge transport layers thereover, a hole blocking layer, an adhesive layer wherein in embodiments the adhesive layer is situated between the photogenerating layer and the hole blocking layer, and in contact with the entire surface of the charge transport layer a top overcoating protective layer as illustrated herein.

In embodiments thereof there is disclosed a photoconductive imaging member comprised of a supporting substrate, a photogenerating layer thereover, a charge transport layer, and an overcoating polymer layer in contact with the charge, such as a hole transport layer; a photoconductive member with a photogenerating layer of a thickness of from about 1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoating layer, and where the transport layer is of a thickness of from about 40 to about 75 microns; a member wherein the photogenerating layer contains a photogenerating pigment present in an amount of from about 10 to about 95 weight percent; a member wherein the thickness of the photogenerating layer is from about 1 to about 4 microns; a member wherein the photogenerating layer contains an inactive polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, especially a first and second layer, or a single charge transport layer and the charge transport compound in the overcoating layer comprises

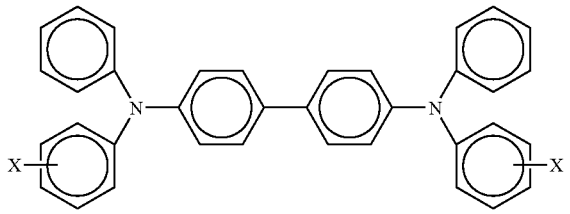

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each or at least one of the charge transport layers, especially a first and second charge transport layer, or a single charge transport layer, and the overcoating charge transport compound comprises

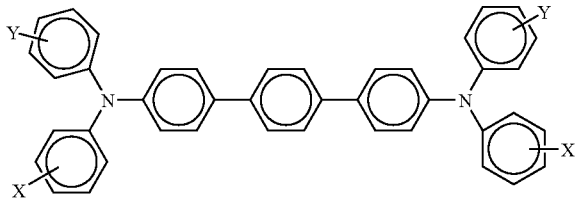

wherein X and Y are independently alkyl, alkoxy, aryl, a halogen, or mixtures thereof; an imaging member wherein, for example, alkyl and alkoxy each contains from about 1 to about 15 carbon atoms; and more specifically, alkyl contains from about 1 to about 6 carbon atoms; and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is two; a member wherein the photogenerating layer is of a thickness of from about 5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 1 to about 11 microns; a member wherein the photogenerating and charge transport layer components are contained in a polymer binder; a member wherein the binder is present in an amount of from about 50 to about 90 percent by weight, wherein the total of the layer components is about 100 percent; and wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport layer and/or overcoating contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoating layer in contact with the hole transport layer, or in embodiments in contact with the photogenerating layer, and in embodiments wherein a plurality of charge transport layers are selected, such as, for example, from 2 to about 10, and more specifically 2 may be selected; a photoconductive imaging member comprised of an optional supporting substrate, a photogenerating layer, and a first, second, and third charge transport layer; an imaging member wherein the overcoating charge transport component is

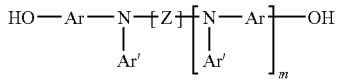

wherein m is zero or 1; Z is selected from the group consisting of at least one of

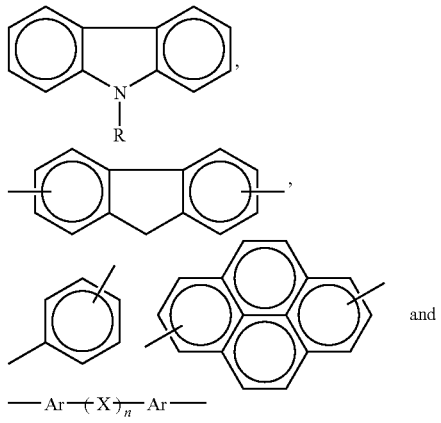

wherein n is 0 or 1; Ar is selected from the group consisting of at least one of

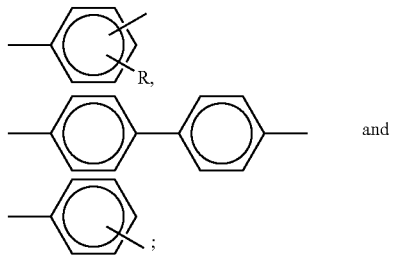

wherein R is selected from the group consisting of at least one of —$CH_3$, —$C_2H_5$, —$C_3H_7$, and $C_4H_9$; Ar' is selected from the group consisting of at least one of

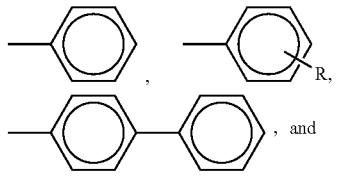

-continued

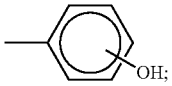

and X is selected from the group consisting of at least one of

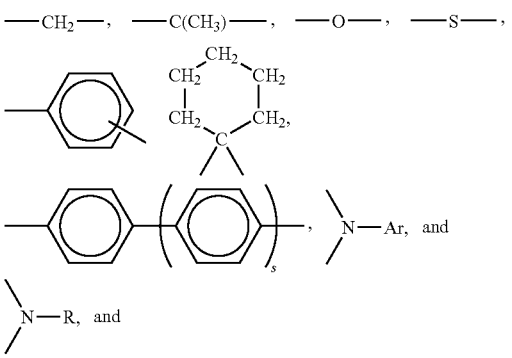

wherein S is zero, 1, or 2; an imaging member wherein the crosslinking agent is a methylated butylated melamine formaldehyde; an imaging member wherein the crosslinking agent is a methoxymethylated melamine compound of the formula $(CH_3OCH_2)_6N_3C_3N_3$; a photoconductor or imaging member wherein the crosslinking agent is

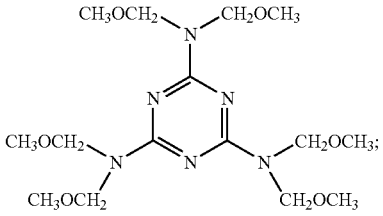

a photoconductor comprising a supporting substrate, a photogenerating layer comprised of a photogenerating component and an optional silanol, and at least one charge transport layer comprised of at least one charge transport component; and a crosslinked overcoating in contact with and contiguous to the charge transport layer, and which overcoating is comprised of a charge transport compound, a polymer, a hydroxy functionalized siloxane polymer, and a crosslinking component; a photoconductor wherein the hydroxy functionalized siloxane polymer is a block copolymer thereof, and is dissolved in a suitable solvent prior to the crosslinking reaction; and a photoconductor comprised in sequence of a supporting substrate, a photogenerating layer comprised of at least one photogenerating pigment, thereover a charge transport layer comprised of at least one charge transport component, and a layer in contact with and contiguous to the top charge transport layer, and which layer is formed by the reaction of an acrylate polyol, an alkylene glycol, a crosslinking agent, a polyhydroxy siloxane block copolymer, and a charge transport compound in the presence of a catalyst resulting in a polymeric network primarily containing the acrylate polyol, the glycol, the crosslinking agent, the polyhydroxy siloxane, and the charge transport compound.

Examples of hydroxyl functionalized siloxanes include hydroxy functionalized siloxane modified polyacrylates which can be represented by $$[HO—[R]_a]—[SiR_1R_2—O—]_n—[[R]_a—OH]_b$$

where R represents $$—CH_2CR_1—[CO_2R_3];$$

a represents the number of repeating $R_s$ and is, for example, from about 1 to about 100; and where $R_1$ and $R_2$ independently represent a suitable substitutent such as a linear alkyl group with, for example, from about 2 to about 20 carbons; n is, for example, from about 5 to about 200; and b is from 0 to about 1; a hydroxy functionalized siloxane polyol which can be represented by $$HO—R_z—[SiR_1R_2—O—]_n—[R_z—OH]_b$$

where $R_z$ represents $$[—[CH_2]_w—O—]_p,$$

and w is from about 2 to about 10, p is from 1 to about 150; and where $R_1$ and $R_2$ independently represent a suitable group like a linear alkyl group with, for example, from about 2 to about 20 carbons; n is, for example, from about 5 to about 200; and b is from 0 to about 1; a hydroxy functionalized siloxane polyol/polyester which can be represented by $$HO—R_x—[SiR_1R_2—O—]_n—[R_x—OH]_b$$

where $R_x$ represents $$(—C—R_a—C)_m—(—CO_2—R_b—CO_2—)_n—(—C—R_c—C)_p—(—CO_2—R_d—CO_2—)$$

where $R_a$ and $R_c$ independently represent a linear alkyl group or a branched alkyl group derived from polyols, the alkyl groups having from 1 to about 20 carbon atoms; $R_b$ and $R_d$ independently represent an alkyl group derived from the polycarboxylic acids, the alkyl groups having, for example, from 1 to about 20 carbon atoms; and m, n, p, and q represent mole fractions of from 0 to 1, such that n+m+p+q=1; and where $R_1$ and $R_2$ independently represent, for example, a linear alkyl group with from about 2 to about 20 carbons; n is, for example, from about 5 to about 200, and b is from 0 to about 1. The R group or substituents specifically recited herein can encompass other suitable substituents in embodiments. Similarly, the numbers, such as for n, b, and x, refer to the number of repeating entities.

The thickness of the photoconductor substrate layer depends on many factors, including economical considerations, electrical characteristics, and the like, thus this layer may be of substantial thickness, for example over 3,000 microns, such as from about 1,000 to about 2,000 microns, from about 500 to about 900 microns, from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer in embodiments is comprised of a number of known photogenerating pigments, such as for example, about 50 weight percent of Type V hydroxygallium phthalocyanine or chlorogallium phthalocyanine, and about 50 weight percent of a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis (benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Infrared sensitivity can be desired for the photoconductors or photoreceptors disclosed, especially when they are exposed to a low cost semiconductor laser diode light exposure device where, for example, the absorption spectrum and photosensitivity of the phthalocyanines selected depend on the central metal atom thereof. Examples of such materials include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The charge transport layer, which layer is generally of a thickness of from about 5 microns to about 75 microns, and more specifically, of a thickness of from about 10 microns to about 40 microns, components, and molecules include a number of known materials, such as aryl amines, of the following formula

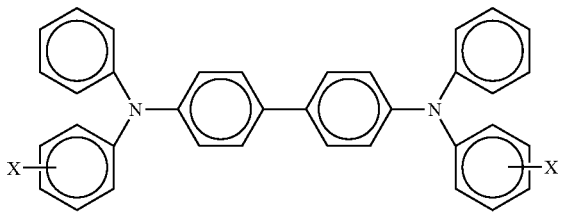

wherein X is alkyl, alkoxy, aryl, a halogen, or mixtures thereof, or wherein each X is present on each of the four terminating rings; and especially those substituents selected from the group consisting of Cl and $CH_3$; and molecules of the following formula

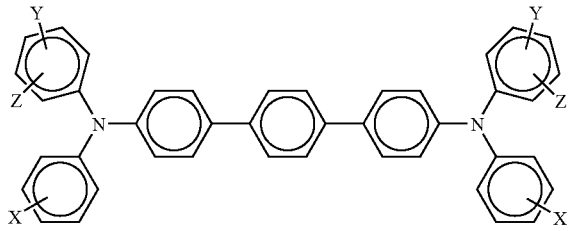

wherein at least one of X, Y and Z are independently alkyl, alkoxy, aryl, a halogen, or mixtures thereof;

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The charge transport layer component can be selected as the charge transport compound for the photoconductor top overcoating layer.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules present in the charge transport layer in an amount of, for example, from about 20 to about 55 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N, N'-bis(4-butylphenyl)-N, N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N, N'-bis(4-butylphenyl)-N,N'-bis-(2-ethyl-6-methylphenyl)-[p-terphenyl]-4,4"-diamine, N, N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triaminotriphenyl methane. A small molecule charge transporting compound that permits injection of holes into the photogenerating layer with high efficiency, and transports them across the charge transport layer with short transit times, and which layer contains a binder and N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and this thickness can be up to about 10 micrometers. In embodiments, this thickness for each layer is from about 1 micrometer to about 5 micrometers. Various suitable and conventional methods may be used to mix, and thereafter apply the overcoat layer coating mixture to the charge transport layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The top charge transport layer can comprise the same components as the charge transport layer wherein the weight ratio between the charge transporting small molecules, and the suitable electrically inactive resin binder is less, such as for example, from about 0/100 to about 60/40, or from about 20/80 to about 40/60.

The photoconductors disclosed herein include a protective overcoating layer (POC) usually in contact with and contiguous to the charge transport layer. This POC layer is comprised of components that include (i) an acrylated polyol, and (ii) an alkylene glycol polymer, such as polypropylene glycol where the proportion of the acrylated polyol to the polypropylene glycol is, for example, from about 0.1:0.9 to about 0.9:0.1, a hydroxy functionalized siloxane modified polyacrylate, at least one transport compound, and at least one crosslinking agent. The overcoat composition can comprise as a first polymer an acrylated polyol with a hydroxyl number of from about 10 to about 20,000, a second polymer of an alkylene glycol with, for example, a weight average molecular weight of from about 100 to about 20,000, a charge transport compound, a hydroxy functionalized siloxane modified polyacrylate, an acid catalyst, and a crosslinking agent wherein the overcoating layer all reacted into a polymeric network. While the percentage of crosslinking can be difficult to determine and not being desired to be limited by theory, the overcoat layer is crosslinked to a suitable value, such as for example, from about 5 to about 50 percent, from about 5 to about 25 percent, from about 10 to about 20 percent, and in embodiments from about 40 to about 65 percent. Excellent photoconductor electrical response can also be achieved when the prepolymer hydroxyl groups, and the hydroxyl groups of the dihydroxy aryl amine (DHTBD) are stoiciometrically less than the available methoxy alkyl on the crosslinking, such as CYMEL® moieties.

The photoreceptor overcoat can be applied by a number of different processes inclusive of dispersing the overcoat composition in a solvent system, and applying the resulting overcoat coating solution onto the receiving surface, for example, the top charge transport layer of the photoreceptor, to a thickness of, for example, from about 0.5 micron to about 10, or from 0.5 to about 8 microns.

According to various embodiments, the crosslinkable polymer present in the overcoat layer can comprise a mixture of a hydroxy functionalized siloxane modified polyacrylate, a polyol and an acrylated polyol film forming resin, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols or a polyfunctional polyol with a low hydroxyl number to form a polymer comprising a number of branches off of the main polymer chain. The polyol can possess a hydroxyl number of, for example, from about 10 to about 10,000 and can be substituted to include, for example, ether groups, or can be free of ether groups. Suitable acrylated polyols can be, for example, generated from the reaction products of propylene oxide modified with ethylene oxide, glycols, triglycerol and the like, and wherein the acrylated polyols can be represented by the following formula $$[R_t—CH_2]_t—[—CH_2—R_a—CH_2]_p—[—CO—R_b—CO—]_n—[—CH_2—R_c—CH_2]_p—[—CO—R_d—CO—]_q$$

where $R_t$ represents a suitable substituent, such as $CH_2CR_1CO_2$—, $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent a suitable substituent, such as linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to about 1, such that n+m+p+q=1. Examples of commercial acrylated polyols are JONCRYL™ polymers, available from Johnson Polymers Inc., and POLYCHEM™ polymers, available from OPC polymers.

The overcoat layer includes in embodiments a crosslinking agent and catalyst where the crosslinking agent can be, for example, a melamine crosslinking agent or accelerator. Incorporation of a crosslinking agent in the overcoat can provide reaction sites to interact with the acrylated polyol to generate a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A nonlimiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure

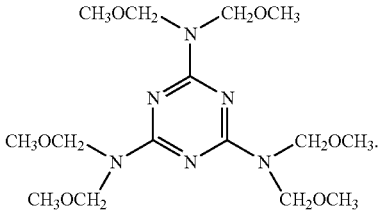

Crosslinking can be accomplished by heating the overcoating components in the presence of a catalyst. Non-limiting examples of catalysts include oxalic acid, maleic acid, carbolic acid, ascorbic acid, malonic acid, succinic acid, tartarc acid, citric acid, p-toluenesulfonic acid, methanesulfonic acid, and the like, and mixtures thereof.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as CYCAT® 4040, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluenesulfonic acid as a catalyst is less than about 140° C., for example 135° C. for about 40 minutes. A typical concentration of acid catalyst is from about 0.01 to about 5 weight percent based on the weight of polyol/acrylated polyol. After crosslinking, the overcoating should be substantially insoluble in the solvent in which it was soluble prior to crosslinking, thus permitting no overcoating material to be removed when rubbed with a cloth soaked in the solvent. Crosslinking results in the development of a three dimensional network which restrains the transport molecule in the crosslinked polymer network.

The overcoat layer can also include a charge transport material to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine; an alcohol-soluble dihydroxy TPD; a N,N'-diphenyl-N,N'-bis(3-hydroxyphenyl)-[1,1'-biphenyl]-4,4'-diamine [DHTPD] represented by

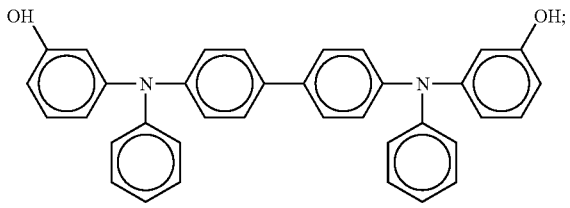

terphenyl arylamine as represented by

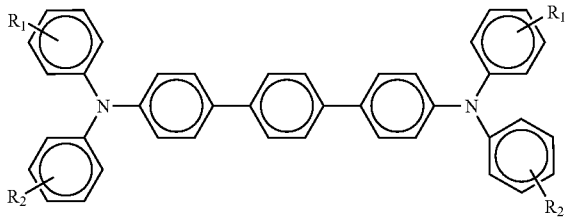

where each R is a suitable substituent, such as alkyl, hydroxy, and the like, and more specifically, $R_1$—OH; and $R_2$ is, for example, independently selected from the group consisting of hydrogen, —$C_nH_{2n+1}$ where n is, for example, from 1 to about 12, aralkyl, and aryl groups, the aralkyl and aryl groups with, for example, from about 6 to about 36 carbon atoms. The dihydroxy arylamine compounds can be free of any direct conjugation between the —OH groups and the nearest nitrogen atom through one or more aromatic rings. The expression "direct conjugation" refers, for example, to the presence of a segment, having the formula —$(C{=}C)_n$—C=C— in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group, or a compound containing a polyphenylene group having an —OH group in the ortho or para position on the terminal phenylene group relative to a nitrogen atom attached to an associated phenylene group. Examples of aralkyl groups include, for example, —$C_nH_{2n}$-phenyl groups where n is from about 1 to about 5, or from about 1 to about 10; examples of aryl groups include, for example, phenyl, naphthyl, biphenyl, and the like. In embodiments, when $R_1$ is —OH and each $R_2$ is n-butyl, the resultant compound is N,N'-bis[4-n-butylphenyl]-N,N'-di[3-hydroxyphenyl]-terphenyl-diamine.

Also, in embodiments, the hole transport compound is soluble in the solvent selected for the formation of the overcoat layer. An example of a terphenyl charge transporting molecule can be represented by the following formula

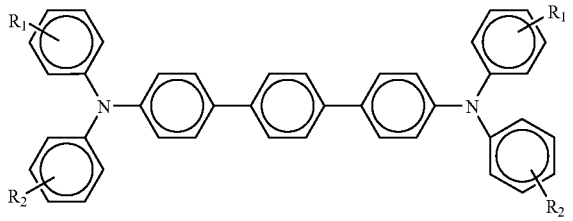

where each $R_1$ is a suitable substituent, such as —OH; and $R_2$ is, for example, hydrogen, alkyl (—$C_nH_{2n+1}$) where, for example, n is from 1 to about 10, from 1 to about 5, or from 1 to about 6; and aralkyl and aryl groups with, for example, from about 6 to about 30, or about 6 to about 20 carbon atoms. Suitable examples of aralkyl groups include, for example, —$C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

Any suitable secondary or tertiary alcohol solvent can be employed for the deposition of the film forming crosslinking polymer composition of the overcoat layer. Typical alcohol solvents include, but are not limited to, for example, tert-butanol, sec-butanol, 2-propanol, 1-methoxy-2-propanol, and the like, and mixtures thereof. Other suitable solvents that can be selected for the forming of the overcoat layer include, for example, tetrahydrofuran, monochlorobenzene, and mixtures thereof. These solvents can be used as diluents for the above alcohol solvents, or they can be omitted. However, in some embodiments, it may be of value to minimize or avoid the use of higher boiling alcohol solvents since they should be removed as they may interfere with efficient crosslinking. In embodiments, the components, including the crosslinkable polymer, charge transport material, hydroxy functionalized siloxane modified polyacrylate, crosslinking agent, acid catalyst, and blocking agent, utilized for the overcoat solution should be soluble or substantially soluble in the solvents or solvents employed for the overcoating.

The thickness of the overcoat layer, which can depend upon the abrasiveness of the charging system (for example bias charging roll), cleaning (for example blade or web), development (for example brush), transfer (for example bias transfer roll), etc., in the system employed is, for example, from about 1 or about 2 microns up to about 10 or about 15 microns, or more. In various embodiments, the thickness of the overcoat layer can be from about 1 micrometer to about 5 micrometers. Typical application techniques for applying the overcoat layer can include spraying, dip coating, roll coating, wire wound rod coating, and the like. Drying of the deposited overcoat layer can be effected by any suitable conventional technique such as oven drying, infrared radiation drying, air drying, and the like. The dried overcoat layer of this disclosure should transport charges during imaging.

In the dried overcoat layer, the composition can include from about 40 to about 90 percent by weight of film forming crosslinkable polymer, and from about 60 to about 10 percent by weight of charge transport material. For example, in embodiments, the charge transport material can be incorporated into the overcoat layer in an amount of from about 20 to about 50 percent by weight. As desired, the overcoat layer can also include other materials, such as conductive fillers, abrasion resistant fillers, and the like, in any suitable and known amounts.

Although not desiring to be limited by theory, the catalyst can be located in the central region with the polymers like the acrylated polyol, polyalkylene glycol, hydroxy functionalized siloxane modified polyacrylate, charge transport component being associated with the catalyst, and extending in embodiments from the central region. Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed, or that may be envisioned.

The following Examples are provided.

Example I

An imaging member or photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive layer contained 0.2 percent by weight, based on the total weight of the solution, of the copolyester adhesive (ARDEL™ D100, available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygailium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting imaging member web was then overcoated with two-charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON 5705®, a known polycarbonate resin having a molecular weight average of from about 50,000 to about 100,000, commercially available from Farbenfabriken Bayer A. G. The resulting mixture was then dissolved in methylene chloride to form a solution containing 15 percent by weight solids. This solution was applied on the photogenerating layer to form the bottom layer coating that upon drying (135° C. for 5 minutes) had a thickness of 14.5 microns. During this coating process, the humidity was equal to or less than 15 percent.

The bottom layer of the charge transport layer was then overcoated with a top charge transport layer. The charge transport layer solution of the top layer was prepared as described above for the bottom layer. The top layer solution was applied on the above bottom layer of the charge transport layer to form a coating. The resulting photoconductor device containing all of the above layers was annealed at 135° C. in a forced air oven for 5 minutes, and thereafter cooled to ambient room temperature, about 23° C. to about 26° C., resulting in a thickness for each of the bottom and top charge transport layers of 14.5 microns. During the coating processes the humidity was equal to or less than 15 percent.

Example II

Preparation of Top Overcoat Coating Solution

An overcoat coating solution was formed by mixing 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), and 5.5 grams [1 percent by weight] of 8 percent p-toluenesulfonic acid in 60 grams of DOWANOL® PM (1-methoxy-2-propanol obtained from the Dow Chemical Company).

The photoconductor of Example I was overcoated with the above overcoat solution using a ⅛ mil Bird bar. The resultant overcoated film was dried in a forced air oven for 2 minutes at 125° C. to yield a 3 micron overcoat, which was substantially crosslinked and substantially insoluble in methanol or ethanol.

Example III

An overcoat coating solution was formed by adding to a 240 milliliter bottle 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), 5.5 grams [1 percent by weight] of 8 percent p-toluenesulfonic acid in 60 grams of DOWANOL® PM (1-methoxy-2-propanol obtained from the Dow Chemical Company), and 1.5 grams of SILCLEAN™ 3700 (a hydroxylated silicone acrylate available from BYK-Chemie USA). The contents were stirred until a complete solution was obtained.

The photoconductor of Example I was overcoated with the above overcoat solution using a ⅛ mil Bird bar. The resultant overcoated film was dried in a forced air oven for 2 minutes at 125° C. to yield a 3 micron overcoat, which was substantially crosslinked and insoluble, or substantially insoluble in methanol or ethanol.

Example IV

An overcoat coating solution was formed by adding 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), 5.5 grams [1 percent by weight] of 8 percent p-toluenesulfonic acid in 60 grams of DOWANOL® PM (1-methoxy-2-propanol obtained from the Dow Chemical Company), and 1.5 grams of TEGO® Protect 5000 (a hydroxy-functional polydimethyl siloxane available from Goldschmidt Chemical Company) to a 240 milliliter bottle. The contents were stirred until a complete solution was obtained.

The photoconductor of Example I was overcoated with the above overcoat solution using a ⅛ mil Bird bar. The resultant overcoated film was dried in a forced air oven for 2 minutes at 125° C. to yield a 3 micron overcoat, which was substantially crosslinked and insoluble, or substantially insoluble in methanol or ethanol.

Example V

No Siloxane

An overcoat coating solution was formed by adding 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), 5.5 grams [1 percent by weight] of 8 percent p-toluenesulfonic acid in 60 grams of DOWANOL® PM (1-methoxy-2-propanol obtained from the Dow Chemical Company), and 1.5 grams of TEGO® Glide 410 (a polyether siloxane copolymer containing no hydroxyl groups available from Goldschmidt Chemical Co.) to a 240 milliliter bottle. The contents were stirred until a complete solution was obtained.

The photoconductor of Example I was overcoated with the above overcoat solution using a ⅛ mil Bird bar. The resultant film was dried in a forced air oven for 2 minutes at 125° C. to yield a 3 micron overcoat, which was substantially crosslinked and insoluble, or substantially insoluble in methanol or ethanol.

Electrical Property Testing

The above prepared photoconductors (Examples I, III, IV, and V) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potentials to generate several voltage versus charge density curves. The scanner was equipped with a scorotron set to a constant voltage charging at various surface potentials. The photoconductors were tested at surface potentials of 500 volts with the exposure light intensity incrementally increased by means of a data acquisition system where the current to the light emitting diode was controlled to obtain different exposure levels. The exposure light source was a 780 nanometer light emitting diode. The xerographic simulation was completed in an environmentally controlled light tight chamber at ambient conditions (45 percent relative humidity and 20° C.). The devices or photoconductors were also cycled to 10,000 cycles electrically with charge-discharge-erase. Photoinduced discharge characteristic (PIDC) curves were generated for each of the above prepared photoconductors at both cycle=0 and cycle=10,000. The results are summarized in Table 1.

TABLE 1

| | V (3.5 ergs/cm$^2$) (V) | |
|---|---|---|
| | Cycle = 0 | Cycle = 10,000 |
| Example II | 94 | 150 |
| Example III | 96 | 153 |
| Example IV | 92 | 144 |
| Example V | 94 | 146 |

The above data indicates that the incorporation of a siloxane additive into the overcoat did not negatively impact the electrical properties of the photoconductors.

Scratch Resistance Testing $R_q$, which represents the surface roughness, can be considered the root mean square roughness as the standard metric for the scratch resistance assessment with a scratch resistance of grade 1 representing poor scratch resistance, and a scratch resistance of grade 5 representing excellent scratch resistance as measured by a surface profile meter. More specifically, the scratch resistance is grade 1 when the $R_q$ measurement is greater than 0.3 micron; grade 2 for $R_q$ between 0.2 and 0.3 micron; grade 3 for $R_q$ between 0.15 and 0.2 micron; grade 4 for $R_q$ between 0.1 and 0.15 micron; and grade 5 being the best or excellent scratch resistance when $R_q$ is less than 0.1 micron.

The above prepared four photoconductive belts (Examples I, III, IV, and V) were cut into strips of 1 inch in width by 12 inches in length, and were flexed in a tri-roller flexing system. Each belt was under a 1.1 lb/inch tension, and each roller was ⅛ inch in diameter. A polyurethane "spots blade" was placed in contact with each belt at an angle of between 5 and 15 degrees. Carrier beads of about 100 micrometers in size diameter were attached to the spots blade by the aid of double-sided tape. These beads struck the surface of each of the belts as the photoconductor rotated in contact with the spots blade for 200 simulated imaging cycles. The surface morphology of each scratched area was then analyzed. The results are summarized in Table 2.

TABLE 2

| SAMPLE | $R_q$, Micron | Rating |
|---|---|---|
| Example II | 0.08 | 5 |
| Example III | 0.07 | 5 |

TABLE 2-continued

| SAMPLE | $R_q$, Micron | Rating |
|---|---|---|
| Example IV | 0.08 | 5 |
| Example V | 0.13 | 4 |

The above data indicates that the incorporation of a hydroxy siloxane copolymer into the overcoat does not negatively impact scratch resistance of the overcoated devices. More specifically, the root mean square roughness, $R_q$ for Examples III, IV (those with hydroxy siloxane copolymers) remain at 0.07 micron, which is similar to that of Example II (overcoat without any siloxane additive). However, incorporation of the siloxane additive without hydroxyl groups (Example V) leads to a reduction in scratch resistance by nearly 50 percent ($R_q$ increases from 0.07 micron to 0.13 micron).

Water Contact Angle

The above prepared four photoconductive belts (Examples I, III, IV, and V) were analyzed for the contact angles of water at ambient temperature, about 23° C., using the Contact Angle System OCA (Dataphysics Instruments GmbH, model OCA15); deionized water was used as the liquid phase. At least ten measurements were performed and their averages were recorded for each photoconductor. The results are summarized in Table 3.

TABLE 3

| SAMPLE | Water Contact Angle, Degrees |
|---|---|
| Example II | 85 |
| Example III | 101 |
| Example IV | 102 |
| Example V | 101 |

The water contact angle of a surface is directly related to the surface energy of that surface. A contact angle of above 90 degrees indicates that the surface is hydrophobic, or non-wettable; whereas, a contact angle of less than 90 degrees indicates that the surface is wettable and thus will attract dirt and debris. Incorporation of the siloxane additives into the overcoat (Examples III, IV and V) render the overcoat surfaces non-wettable, which enable easier toner transfer, sufficient photoreceptor cleaning, and lower photoreceptor torque during printing. A water contact angle of the overcoat surface without a siloxane additive (Example II) is only 85 degrees, which renders the surface hydrophilic and more attractive to dirt. In Example V the overcoat contact angle is 101, however, the overcoat is at least partially removed from the surface after a few printing cycles because it is not sufficiently bonded to the crosslinked OC. Further, the $R_q$ of Example V indicates a more easily scratched surface.

X-Ray Photoelectron Spectroscopy

The above prepared four photoconductive belts (Examples II, III, IV, and V) were analyzed for siloxane distribution in the overcoat, using the known X-ray Photoelectron Spectroscopy (XPS) method, a surface analysis technique that provides elemental, chemical state, and quantitative analysis for the top 2 to 5 nanometers of a sample's surface. A region about 800 microns in diameter was analyzed. The 1 $cm^2$ sections were held beneath a molybdenum mask. The limits of detection of the technique were about 0.1 atom percent for the top 2 to 5 nanometers. The quantitative analysis was precise to within 5 percent relative for major constituents, and 10 percent relative for minor constituents. The coatings were argon ion etched for 2 minutes to remove surface layers and were then re-analyzed. The ion beam consisted of 3 keV argon ions rastered over an area of 1 $mm^2$. The etching should remove about 180 Angstroms of material from the surface per minute as calibrated against a BLS standard film. The profiles were terminated after 2 minutes of etching into a 1 hour depth profile. The analysis was terminated when silicon was not detected. Results from these measurements showed that siloxane component resides not only at the surface of the overcoat but also at least 0.5 micron to 1 micron into the overcoat. Such results enabled the presence of siloxane and low surface energy of the device throughout the xerographic imaging cycles for an extended time period.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member comprising an optional supporting substrate, a photogenerating layer, and at least one charge transport layer comprised of at least one charge transport component, and an overcoating layer in contact with and contiguous to said charge transport layer, and which overcoating is comprised of an acrylated polyol, a polyalkylene glycol, a crosslinking agent, a hydroxy functionalized siloxane and a charge transport component.

2. An imaging member in accordance with claim 1 wherein said supporting substrate is present, said overcoating layer further contains a catalyst, and said polyalkylene glycol is a polypropylene glycol.

3. An imaging member in accordance with claim 1 wherein the acrylated polyol has a hydroxyl number of from about 10 to about 20,000, and wherein said acrylate polyol, said hydroxy functionalized siloxane, said polyalkylene glycol, and said charge transport component are reacted in the presence of an acid catalyst to form a crosslinked polymeric network.

4. An imaging member in accordance with claim 1 wherein the acrylated polyol has a hydroxyl number of from about 500 to about 2,000, and wherein said hydroxy functionalized siloxane is a block copolymer.

5. An imaging member in accordance with claim 2 wherein said polypropylene glycol possesses a weight average molecular weight of from about 100 to about 20,000, and wherein said acrylated polyol, said propylene glycol, said crosslinking agent, said hydroxy functionalized siloxane, and said charge transport component are reacted in the presence of said catalyst to form a crosslinked polymeric network.

6. An imaging member in accordance with claim 2 wherein said polypropylene glycol possesses a weight average molecular weight of from about 100 to about 5,000.

7. An imaging member in accordance with claim 2 wherein the weight ratio of said acrylated polyol to said polypropylene glycol is from about 2:8 to about 8:2 wherein said acrylated polyol, said polypropylene glycol, said hydroxyl functionalized siloxane, said crosslinking agent, and said charge transport component are reacted in the presence of said catalyst resulting in a crosslinked polymeric network containing said acrylated polyol, said polypropylene glycol, said crosslinking agent, said catalyst, and said charge transport component, and wherein said hydroxy functionalized siloxane is dissolved in an alcohol solvent prior to said reaction.

8. An imaging member in accordance with claim 1 wherein the overcoating charge transport component is selected from the group consisting of a phenolic substituted aromatic amine, a primary alcohol substituted aromatic amine, and mixtures thereof.

9. An imaging member in accordance with claim 1 wherein the overcoating charge transport component is wherein m is zero or 1; Z is selected from the group consisting of

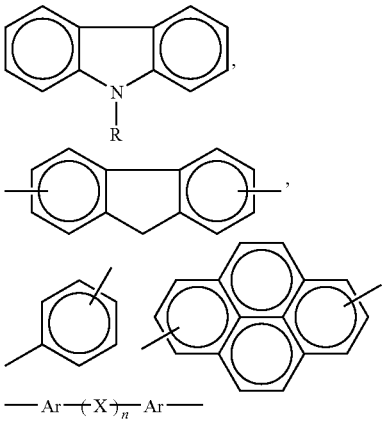

and mixtures thereof, wherein n is 0 or 1; Ar is selected from the group consisting of

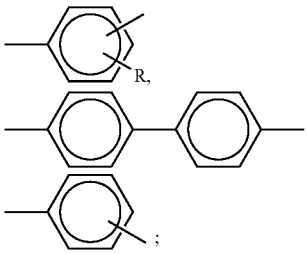

and mixtures thereof, wherein R is selected from the group consisting of —CH.sub.3, —C.sub.2H.sub.5, —C.sub.3H.sub.7, C.sub.4H.sub.9, and mixtures thereof; Ar' is selected from the group consisting of

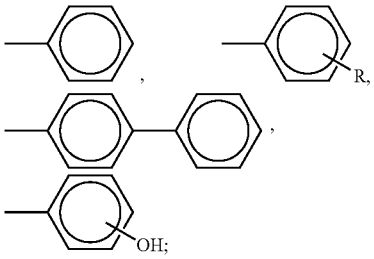

and mixtures thereof and X is selected from the group consisting of

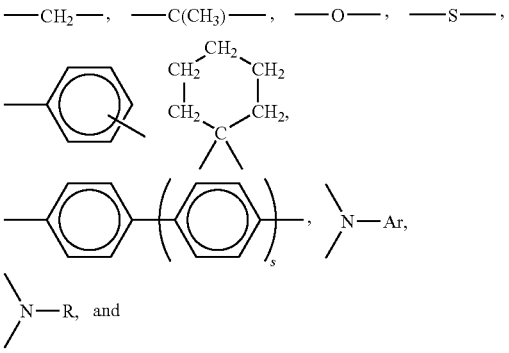

and mixtures thereof wherein S is zero, 1, or 2.

10. An imaging member in accordance with claim 1 wherein the crosslinking agent is a methylated butylated melamine formaldehyde.

11. An imaging member in accordance with claim 1 wherein said crosslinking agent is a methoxymethylated melamine compound of the formula (CH.sub.30CH.sub.2).sub.6N.sub.3C.sub.3N.sub.3.

12. An imaging member in accordance with claim 1 wherein said crosslinking agent is

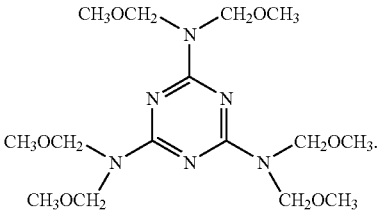

13. An imaging member in accordance with claim 1 wherein said hydroxyl functionalized siloxane is a hydroxy functionalized siloxane modified polyacrylate.

14. An imaging member in accordance with claim 1 wherein said charge transport component for said charge transport layer, and for said overcoating layer is at least one of N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)-[1,1',4',1"-terphenyl]-4,4"-diamine; 9-ethyl-3,6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; and 1,4-bis[N-phenyl-N-(3-hydroxyphenyl)]-phenylenediamine.

15. A photoconductor comprising a supporting substrate, a photogenerating layer comprised of a photogenerating component, and at least one charge transport layer comprised of at least one charge transport component; and a crosslinked overcoating in contact with and contiguous to said charge transport layer, and which overcoating is comprised of a charge transport compound, a polymer, a hydroxy functionalized siloxane polymer, and a crosslinking component, wherein said polymer is comprised of at least one of an acrylated polyol and a polyalkylene glycol.

16. A photoconductor in accordance with claim 15 wherein said charge transport component in said charge transport layer is comprised of an acrylated polyol and an alkylene glycol, and said hydroxy functionalized siloxane polymer is reacted in the presence of said crosslinking component, and a catalyst resulting in a crosslinked polymeric network containing said acrylated polyol, said polyalkylene glycol, said hydroxy functionalized siloxane polymer, said crosslinking agent, and said charge transport compound.

17. A photoconductor in accordance with claim 16 wherein said hydroxy functionalized siloxane polymer is a block copolymer thereof, and is dissolved in a suitable solvent prior to said reaction.

18. A photoconductor in accordance with claim 15 wherein said charge transport component for said charge transport layer is comprised of aryl amine molecules, and which aryl amines are of the formula

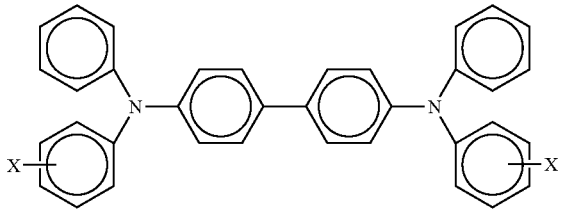

wherein X is selected from the group comprised of alkyl, alkoxy, aryl, and halogen.

19. A photoconductor in accordance with claim 18 wherein said alkyl and said alkoxy each contains from about 1 to about 12 carbon atoms, and said aryl contains from about 6 to about 36 carbon atoms.

20. A photoconductor in accordance with claim 18 wherein said aryl amine is N,N'-diphenyl-N,N-bis(3-methylphenyl)-1,1'-biphenyl-4,4'-diamine.

21. A photoconductor in accordance with claim 15 wherein said charge transport component for said charge transport layer is comprised of an aryl amine

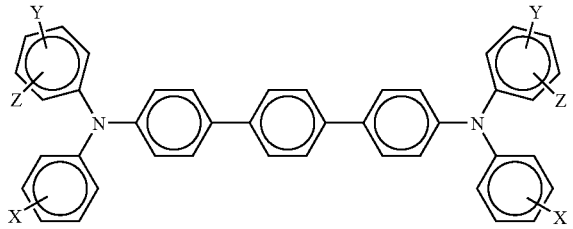

wherein X, Y and Z are independently selected from the group comprised of alkyl, alkoxy, aryl, halogen, and mixtures thereof.

22. A photoconductor in accordance with claim 21 wherein said alkyl and alkoxy each contains from about 1 to about 12 carbon atoms, and said aryl contains from about 6 to about 36 carbon atoms.

23. A photoconductor in accordance with claim 21 wherein said aryl amine is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butyl phenyl)-N,N'-bis-4-isopropylphenyl)-[p-terphenyl]-4,4"-diamine, N,N'-bis(4-butylphenyl)-N,N'-bis-(2-ethyl-6-methylphenyl)-[p-terphenyl]-4-,4"-diamine, N,N'-bis(4-butylphenyl)-N,N'-bis-(3,4-dimethylphenyl)-[p-terphenyl]-4,4"-diamine, N,N'-diphenyl-N,N'-bis(3-chlorophenyl)-[p-terphenyl]-4,4"-diamine, and mixtures thereof.

24. A photoconductor in accordance with claim 15 wherein said hydroxy functionalized siloxane polymer is present in an amount of from about 0.1 to about 10 weight percent; at least one charge transport layer is comprised of from about 2 to about 4 transport layers, wherein the charge transport layers contain hole transport molecules and a resin binder; and wherein said photogenerating layer is situated between said substrate and said charge transport layer.

25. A photoconductor in accordance with claim 15 further including in at least one of said charge transport layers an antioxidant comprised of at least one of a hindered phenolic and a hindered amine.

26. A photoconductor in accordance with claim 15 wherein said photogenerating component is comprised of a photogenerating pigment or photogenerating pigments.

27. A photoconductor in accordance with claim 26 wherein said photogenerating pigment is comprised of at least one of a metal phthalocyanine, a metal free phthalocyanine, a titanyl phthalocyanine, a halogallium phthalocyanine, a perylene, or mixtures thereof.

28. A photoconductor in accordance with claim 26 wherein said photogenerating pigment is comprised of at least one of a titanyl phthalocyanine, a chlorogallium phthalocyanine, and a hydroxygallium phthalocyanine.

29. A photoconductor in accordance with claim 15 further including a hole blocking layer and an adhesive layer.

30. A photoconductor in accordance with claim 15 wherein said at least one charge transport layer is from 1 to about 7 layers, and the substrate is comprised of a conductive component.

31. A photoconductor in accordance with claim 15 wherein said at least one charge transport layer is from 1 to about 3 layers.

32. A photoconductor in accordance with claim 15 wherein said at least one charge transport layer is comprised of a top charge transport layer and a bottom charge transport layer, and wherein said top layer is in contact with said bottom layer, and said bottom layer is in contact with said photogenerating layer.

33. A photoconductor comprised in sequence of a supporting substrate, a photogenerating layer comprised of at least one photogenerating pigment, thereover a charge transport layer, which is comprised of a to charge transport layer and a bottom charge transport layer, and is comprised of at least one charge transport component, and a layer in contact with and contiguous to said top charge transport layer, and which layer is formed by the reaction of an acrylated polyol, an alkylene glycol, a crosslinking agent, a polyhydroxy siloxane block copolymer, and a charge transport compound in the presence of a catalyst resulting in a polymeric network primarily containing said acrylated polyol, said alkylene glycol, said crosslinking agent, said polyhydroxy siloxane and said charge transport compound.

34. A photoconductor in accordance with claim 33 wherein said acrylated polyol is represented by $$[R_s—CH_2]_t—[—CH_2—R_a—CH_2]_p—[—CO—R_b—CO—]_n—[CH_2—R_c—CH_2]_p—[—CO—R_d—CO—]_q$$

where $R_s$ represents $CH_2CR_1CO_2$ where t is from 0 to about 1, and represents the mole fraction thereof; $R_a$ and $R_c$ independently represent at least one of a linear alkyl group, a linear alkoxy group, a branched alkyl group, and a branched alkoxy group, wherein each alkyl and alkoxy group contain from about 1 to about 20 carbon atoms; $R_b$ and $R_d$ independently represent at least one of an alkyl and alkoxy wherein said alkyl and said alkoxy each contain from about 1 to about 20 carbon atoms; and m, n, p, and q represent mole fractions of from 0 to about 1, such that n+m+p+q=1; and wherein said polymeric network primarily contains said acrylated polyol, said alkylene glycol, said crosslinking agent, and said charge transport compound.

* * * * *